US009527621B1

(12) United States Patent
Choi

(10) Patent No.: US 9,527,621 B1
(45) Date of Patent: Dec. 27, 2016

(54) LIQUID CONTAINER WITH SPOUT WITH BEING EASILY OPENED

(71) Applicant: Il Ho Choi, Jeollabuk-do (KR)

(72) Inventor: Il Ho Choi, Jeollabuk-do (KR)

( * ) Notice: Subject to any disclaimer, the term of this patent is extended or adjusted under 35 U.S.C. 154(b) by 0 days.

(21) Appl. No.: 15/201,022

(22) Filed: Jul. 1, 2016

(51) Int. Cl.

| | |
|---|---|
| ***B65D 5/06*** | (2006.01) |
| ***B65D 5/74*** | (2006.01) |
| ***B65D 5/02*** | (2006.01) |
| ***B65D 5/40*** | (2006.01) |

(52) U.S. Cl.
CPC ..... *B65D 5/069* (2013.01); *B65D 5/0227* (2013.01); *B65D 5/0236* (2013.01); *B65D 5/40* (2013.01); *B65D 5/742* (2013.01)

(58) Field of Classification Search
CPC ..... B65D 5/069; B65D 5/0236; B65D 5/40; B65D 5/742; B65D 5/0227; B65D 5/067
USPC ..... 229/125.42, 137, 213, 214, 246, 248,229/249, 125.39
See application file for complete search history.

(56) References Cited

U.S. PATENT DOCUMENTS

| | | | | |
|---|---|---|---|---|
| 3,458,110 A * | 7/1969 | Goldman | B65D 5/069 | 229/125.04 |
| 3,956,975 A * | 5/1976 | Egleston | B29C 65/08 | 156/73.1 |
| 4,251,303 A * | 2/1981 | Deimel | B29C 65/08 | 156/182 |
| 4,313,553 A * | 2/1982 | Lisiecki | B65D 5/068 | 229/249 |
| 4,860,902 A * | 8/1989 | Kieser | B65D 5/067 | 229/125.42 |
| 5,002,222 A * | 3/1991 | Giblin | B65D 5/708 | 229/122 |
| 5,184,997 A * | 2/1993 | James | B65B 51/067 | 229/125.39 |
| 5,558,438 A * | 9/1996 | Warr | B65D 75/5816 | 383/10 |
| 5,890,347 A * | 4/1999 | Giacomelli | B29C 65/08 | 156/580.1 |
| 5,897,210 A * | 4/1999 | Giblin | B65D 33/16 | 220/256.1 |
| 6,024,280 A * | 2/2000 | Marovskis | B65D 5/068 | 229/137 |
| 6,436,500 B1 * | 8/2002 | Yingst | B32B 3/10 | 206/807 |

FOREIGN PATENT DOCUMENTS

| | | | |
|---|---|---|---|
| JP | H6-8305 | U | 2/1994 |
| JP | 2535935 | Y2 | 5/1997 |
| KR | 1998-058592 | U | 10/1998 |
| KR | 20-0267944 | Y1 | 3/2002 |
| KR | 10-2004-0107070 | A | 12/2004 |

* cited by examiner

*Primary Examiner* — Gary Elkins
(74) *Attorney, Agent, or Firm* — KORUS Patent, LLC; Seong Il Jeong

(57) ABSTRACT

In a liquid container with easy opening of a spout thereof in accordance with the present disclosure, the spout may be more easily opened due the inner non-adhered faces of the proximal and distal wings of the spout. Further, in accordance with the present disclosure, the spout may be more easily opened due the outer non-adhered faces of the distal wings. Thus, the damage of the distal and proximal wings may be prevented.

2 Claims, 6 Drawing Sheets

LIQUID CONTAINER WITH SPOUT WITH BEING EASILY OPENED

CROSS-REFERENCE TO RELATED APPLICATION

This application claims the benefit of Korea Patent Application No. 10-2015-0117420 filed on Aug. 20, 2015, the entire content of which is incorporated herein by reference for all purposes as if fully set forth herein.

BACKGROUND

Field of the Present Disclosure

The present disclosure relates to a liquid container, and, more particularly, to a liquid container with a spout with being easily opened. More particularly, the present disclosure relates to a liquid container with a spout having partially non-adhered outer and inner faces to allow the spout to be easily opened initially.

Discussion of the Related Art

A liquid container to receive a liquid such as a beverage as shown in FIG. 6 may be formed by folding a planar development along folding lines 200 as shown in FIG. 7 to form a cubic shape. The container may have a spout 100 at a top thereof.

As shown in FIG. 6, the spout 100 may include two proximal wings 110 extending from a body of the liquid container, and two distal wings 120 extending from the proximal wings 110 respectively. The two proximal wings 110 may be branched from a non-spout top portion of the body of the container.

The two proximal wings 110 may be partially formed as a top portion of the container. When the container is closed at the spout thereof, the distal wings 120 are pushed inwardly to contact the corresponding proximal wings 110 respectively. When the container is opened, the distal wings 120 are pulled outwardly to be separated from the corresponding proximal wings 110 respectively.

The proximal wings 110 may include first and second proximal wings branched away from each other. The first and second proximal wings have first and second proximal inner adhered faces 110*b* respectively. The distal wings 120 may include first and second distal wings coupled to the first and second proximal wings respectively. The first and second distal wings have first and second distal inner adhered faces 110*a* respectively. The first and second proximal inner adhered faces and first and second distal inner adhered faces may be adhered to each other respectively.

The first and second distal wings have first and second distal outer adhered faces 120*a* and 120*b* respectively. The first and second distal outer adhered faces may be adhered to each other. The first and second proximal wings 110 may have first and second free end portions upwardly protruding from the first and second proximal inner non-adhered faces respectively. The first and second free end portions have first and second free-end inner adhered faces 130*a* and 130*b* respectively. The adhering between the first and second free-end inner adhered faces 130*a* and 130*b* may allow more secure coupling between the first and second proximal wings 110.

It may be difficult to open the spout 100 of the above container. Further, the forcedly opening of the spout may lead to a damage of the spout.

In order to solve the problem, following prior patent documents are disclosed: patent document 1: Korean utility model publication number 20-1998-058592; patent document 2: Korean utility model registration number 0267944; and patent document 3: Korean patent application publication number 10-2004-0107070.

The patent document 1 relates to the milk pack and the milk pack which it can be with one hand released that it develops in order to solve as to the conventional milk pack inconvenient. The advanced milk pack which one makes with the coverage part and copula curved portion on the junction and it makes in both sides unsealing with two and relatively the junction of the junction is less than those of the existing milk pack and the unsealing is easy and the lips tight fit part of the opening is horizontal in the tasting and the lips has the coverage part in storage while adhering closely to the lips and nots spilling and the air interception can be facilitated and the handicapped person can be easily released.

The patent document 2 provides milk, the inner surface of the upper part while having the fixed space on the inside to the purpose that store and preserve provide the paper pack container which the opened opening does not get damaged while it is easy and it is facilitated opening the container as the paper pack container and smoothly can drink the beverage of the inside both side part of the body having an opened top portion is the various kinds of drinks number including the juice etc. folded in the inside, and the paper pack container in which the protrusion piece is prepared in the upper center of the side part of one side of both side part folded as to the paper pack container in which the outer periphery of both side part is sealed with adhesion.

The patent document 2 provides an easy open type carton pack with an improved structure to make opening the carton pack easier for users, and maintain a tightly bonded state otherwise. The easy open type carton pack has a box-shaped three dimensional structure when folded along a bending line. The carton pack is made of paper and polyethylene resin coating layers formed at upper and lower parts of the paper. Instead of using a silicon coating, half-cut parts are formed on the bonded surface between the front side and the lateral sides. Therefore, the cohesive force between the polyethylene resin coating layers maintain a tightly bonded state of the carton pack, and the half-cut parts make it easier for a user to open the carton pack.

In the patent document 1, an initial opening of the spout may be difficult. In the patent documents 2 and 3, a separation between the outer faces of the distal wings of the spout may be difficult.

SUMMARY

From considerations of the above situations, the present disclosure provides a liquid container with a spout with being easily opened. More particularly, the present disclosure relates to a liquid container with a spout having partially non-adhered outer and inner faces to allow the spout to be easily opened initially.

In an aspect of the present disclosure, there is provided a liquid container comprising: a body having an inner space defined therein; and a spout coupled to the body at a top thereof, wherein the spout is to be opened to allow a liquid in the inner space to be discharged out of the inner space, wherein the spout includes first and second proximal wings extending from the body, and first and second distal wings extending from the first and second proximal wings respectively, wherein the first and second proximal wings have first and second proximal lower inner adhered faces respectively, wherein the first and second distal wings have first and second distal lower inner adhered faces respectively, wherein the first and second proximal lower inner adhered faces and first and second distal lower inner adhered faces are adhered to each other respectively, wherein the first and second proximal wings have first and second proximal upper inner non-adhered faces respectively, wherein the first and second distal wings have first and second distal upper inner non-adhered faces respectively, wherein the first and second proximal upper inner non-adhered faces are at the same level as the first and second distal upper inner non-adhered faces, wherein the first and second proximal upper inner non-adhered faces only contact but do not adhere to the first and second distal upper inner non-adhered faces respectively, wherein the first and second distal wings have first and second distal lower outer adhered faces respectively, wherein the first and second distal lower outer adhered faces are adhered to each other, wherein the first and second distal wings have first and second distal upper outer non-adhered faces respectively, wherein the first and second distal upper outer non-adhered faces only contacts but do not adhere to each other, wherein the first and second proximal wings have first and second free end portions upwardly protruding from the first and second proximal upper inner non-adhered faces respectively, wherein the first and second free end portions have first and second free-end inner adhered faces respectively, wherein the adhering between the first and second free-end inner adhered faces allows secure coupling between the first and second proximal wings.

In one embodiment, an anti-adhesion agent is applied on the inner non-adhered faces of the proximal and distal wings and the outer non-adhered faces of the distal wings.

In one embodiment, the anti-adhesion agent includes an anti-adhesion oil.

In one embodiment, a closing tape is detachably attached to the body of the liquid container, wherein after the adhered faces of the wings of the spout are separated first, the closing tape is displaced to the spout to close the spout.

In one embodiment, a closing tape has an adhesive portion and a non-adhesive portion adjacent to the adhesive portion.

In accordance with the present disclosure, the spout may be more easily opened due the inner non-adhered faces of the proximal and distal wings. Thus, the damage of the proximal and distal wings may be prevented, which may occur when the inner non-adhered faces of the proximal and distal wings are not present as in the conventional container.

Further, in accordance with the present disclosure, the spout may be more easily opened due the outer non-adhered faces of the distal wings. Thus, the damage of the distal wings may be prevented, which may occur when the outer non-adhered faces of the distal wings are not present as in the conventional container.

BRIEF DESCRIPTIONS OF THE DRAWINGS

The accompanying drawings included to provide a further understanding of the present disclosure illustrate embodiments of the present disclosure.

DETAILED DESCRIPTIONS

Figure 1:
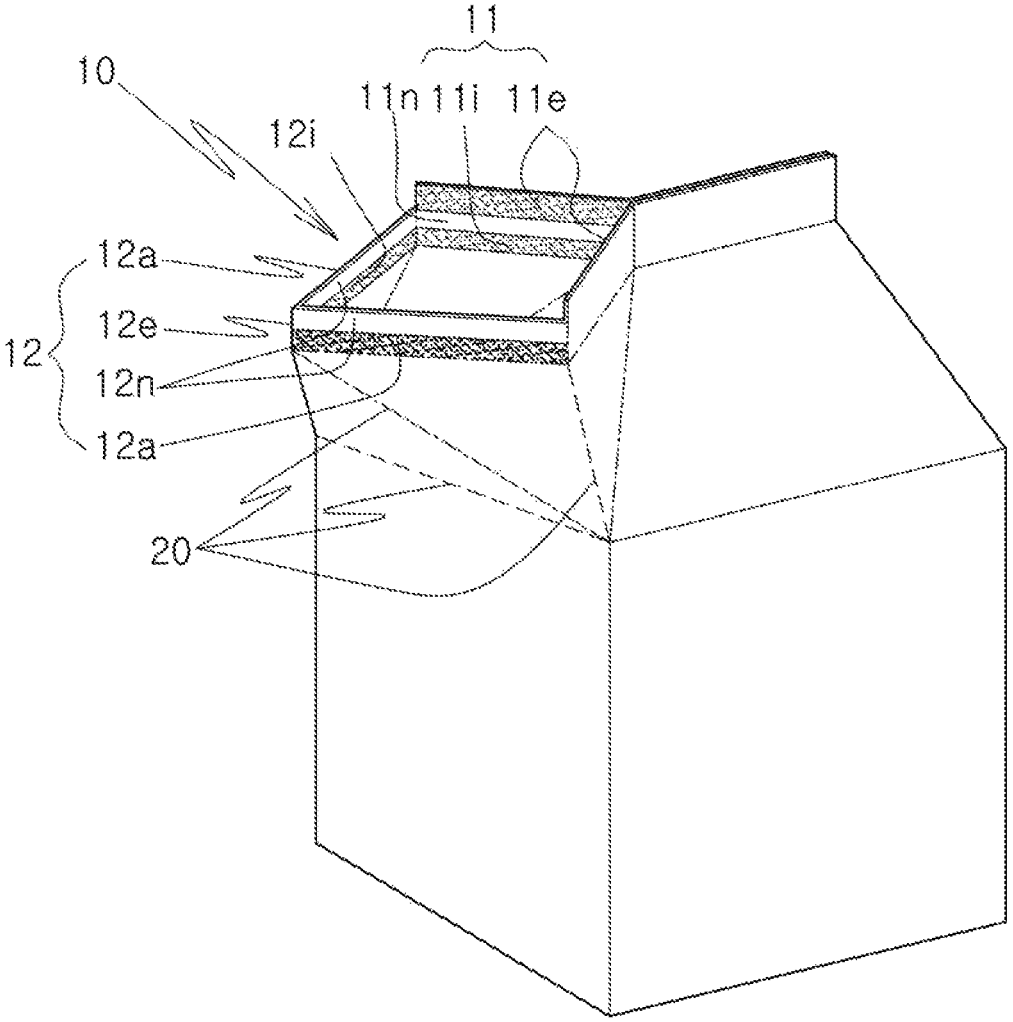
FIG. 1 shows a liquid container with easy opening of a spout thereof in accordance with the present disclosure where the spout is open.

Examples of various embodiments are illustrated in the accompanying drawings and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

Example embodiments will be described in more detail with reference to the accompanying drawings. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "connected to", or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, s, operations, elements, and/or components, but do not preclude the presence or addition of one or more other features, integers, s, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

Spatially relative terms, such as "beneath," "below," "lower," "under," "above," "upper," and the like, may be used herein for ease of explanation to describe one element or feature's relationship to another element s or feature s as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented for example, rotated 90 degrees or at other orientations, and the spatially relative descriptors used herein should be interpreted accordingly.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In the following description, numerous specific details are set forth in order to provide a thorough understanding of the present disclosure. The present disclosure may be practiced without some or all of these specific details. In other instances, well-known process structures and/or processes have not been described in detail in order not to unnecessarily obscure the present disclosure.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present disclosure refers to "one or more embodiments of the present disclosure."

Hereinafter, embodiments of the present disclosure will be described in details with reference to attached drawings.

A liquid container with easy opening of a spout thereof in accordance with the present disclosure may include a non-adhered portion 12*n* of the spout which may act as a griped portion when the user opens the container.

Figure 2:
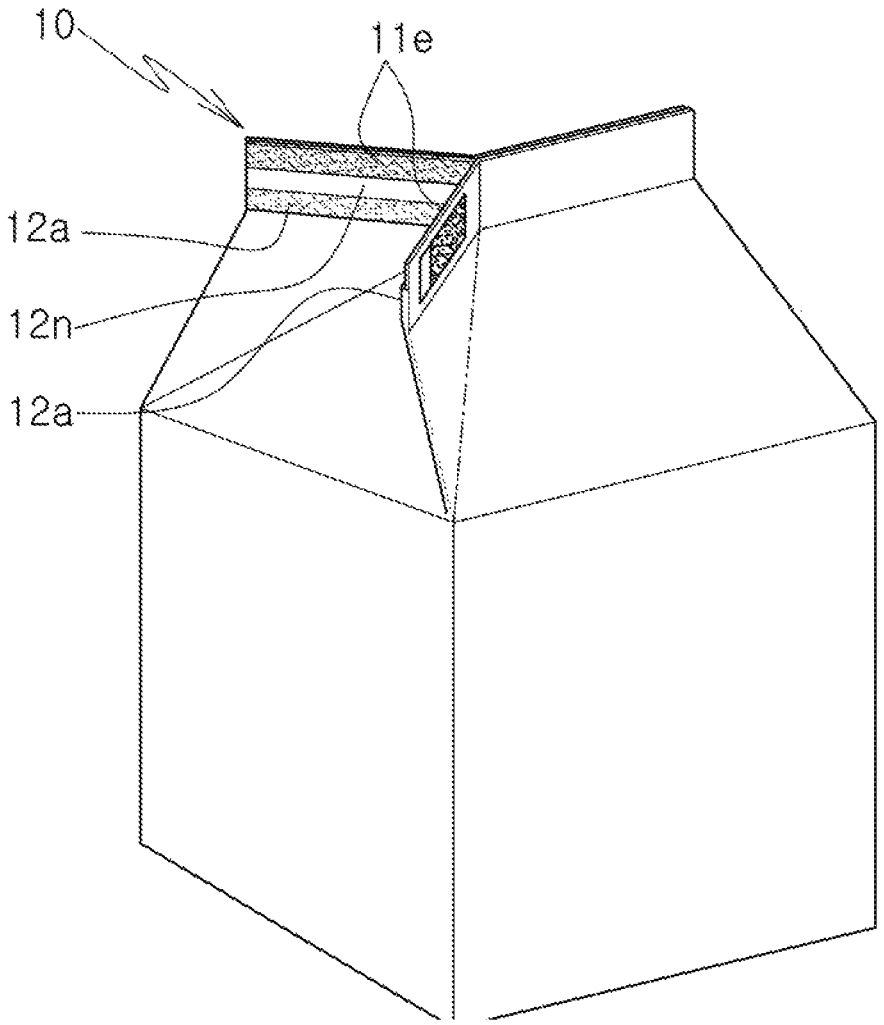
FIG. 2 shows a liquid container with easy opening of a spout thereof in accordance with the present disclosure wherein a spout is closed but first and second outer faces of first and second distal wings respectively do not contact each other but are separated from each other.
Figure 4:
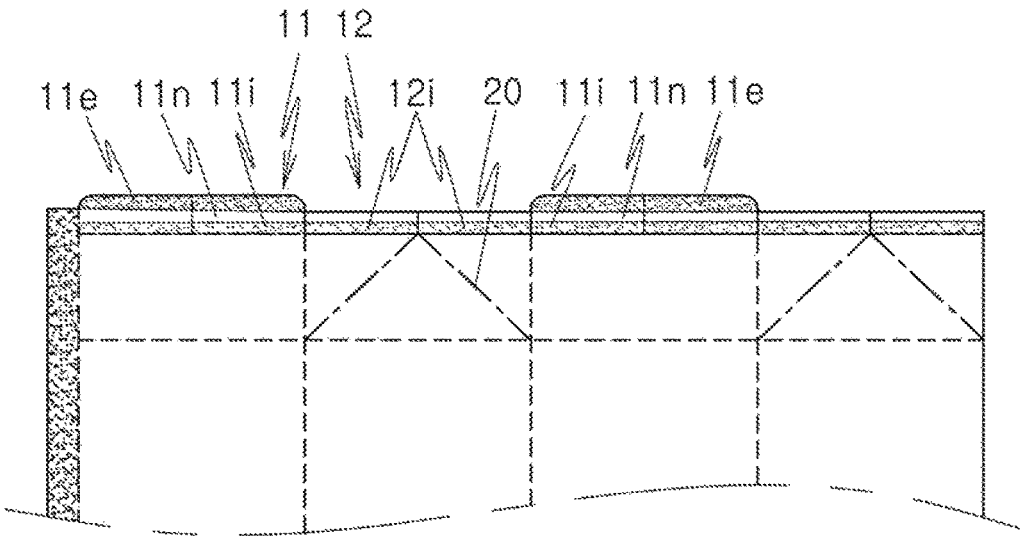
FIG. 4 shows an inner face of a planar development of a liquid container with easy opening of a spout thereof in accordance with the present disclosure.
Figure 5:
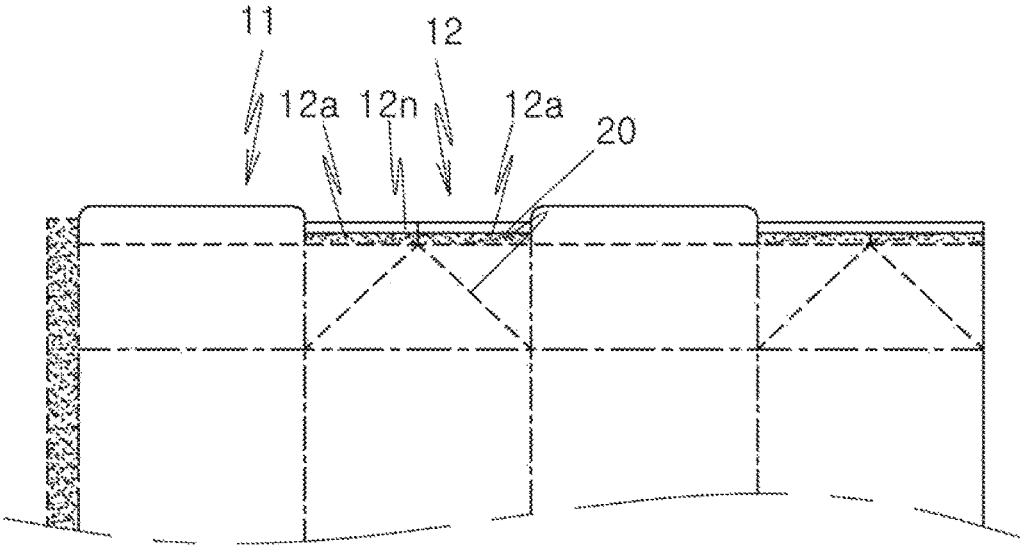
FIG. 5 shows an outer face of a planar development of a liquid container with easy opening of a spout thereof in accordance with the present disclosure.
Figure 6:
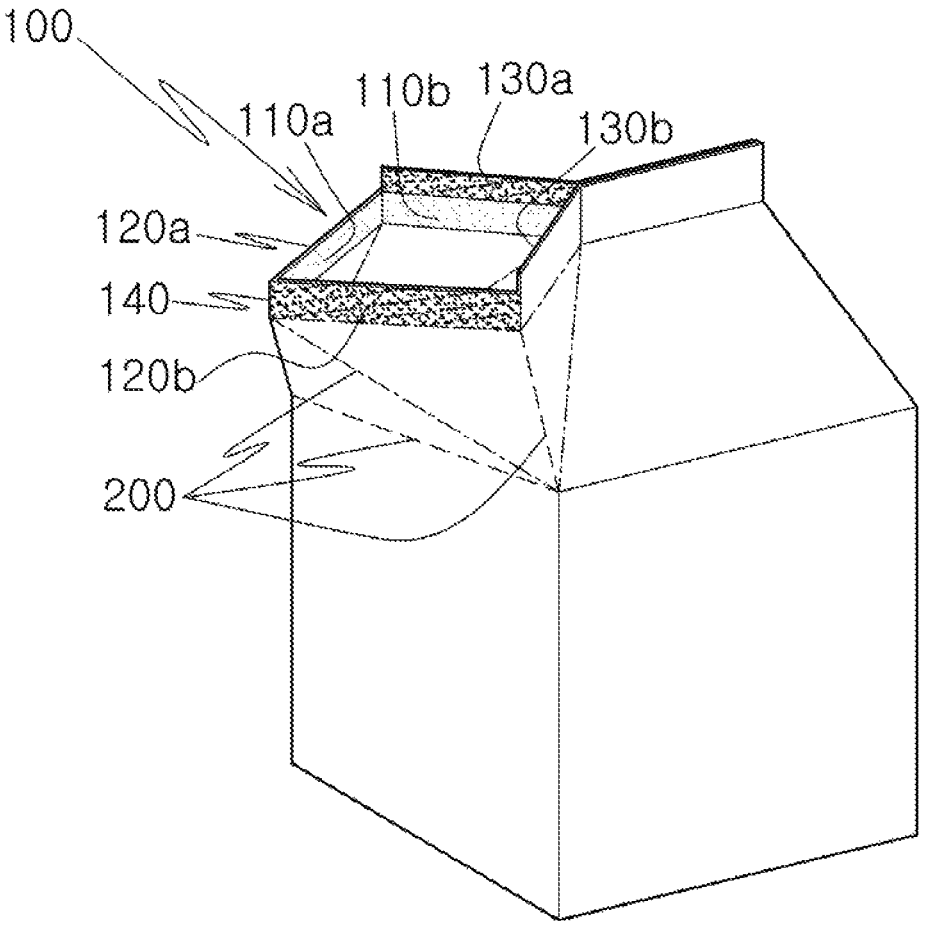
Prior Art FIG. 6
FIG. 6 shows a liquid container with easy opening of a spout thereof in accordance with a prior art where the spout is open.

The liquid container with easy opening of the spout thereof in accordance with the present disclosure may be used to contain therein a beverage. The liquid container with easy opening of the spout thereof in accordance with the present disclosure may be formed by folding a planar development of a paper or film as shown in FIG. 4 and FIG. 5 along folding lines 20 and by adhering certain portions to each other. As shown in FIG. 1 and FIG. 2, the folded and adhered liquid container may have a cubic shape, and have the spout 10 formed at one side of a top portion thereof to be configured to be closed and opened.

As shown in FIG. 1, the spout 10 may include two proximal wings 11 extending from a body of the liquid container, and two distal wings 12 extending from the proximal wings 11 respectively. The two proximal wings 11 may be branched from a non-spout top portion of the body of the container.

The two proximal wings 11 may be partially formed as a top portion of the container. When the container is closed at the spout thereof, the distal wings 12 are pushed inwardly to contact the corresponding proximal wings 11 respectively. When the container is opened, the distal wings 12 are pulled outwardly to be separated from the corresponding proximal wings 11 respectively.

The proximal wings 11 may include first and second proximal wings branched away from each other. The first and second proximal wings have first and second proximal lower inner adhered faces 11*i* respectively. The distal wings 12 may include first and second distal wings coupled to the first and second proximal wings respectively. The first and second distal wings have first and second distal lower inner adhered faces 12*i* respectively. The adhering between the first and second proximal lower inner adhered faces 11*i* and first and second distal lower inner adhered faces 12*i* respectively may allow the container to be closed at the spout 10 as shown in FIG. 2.

Figure 7:
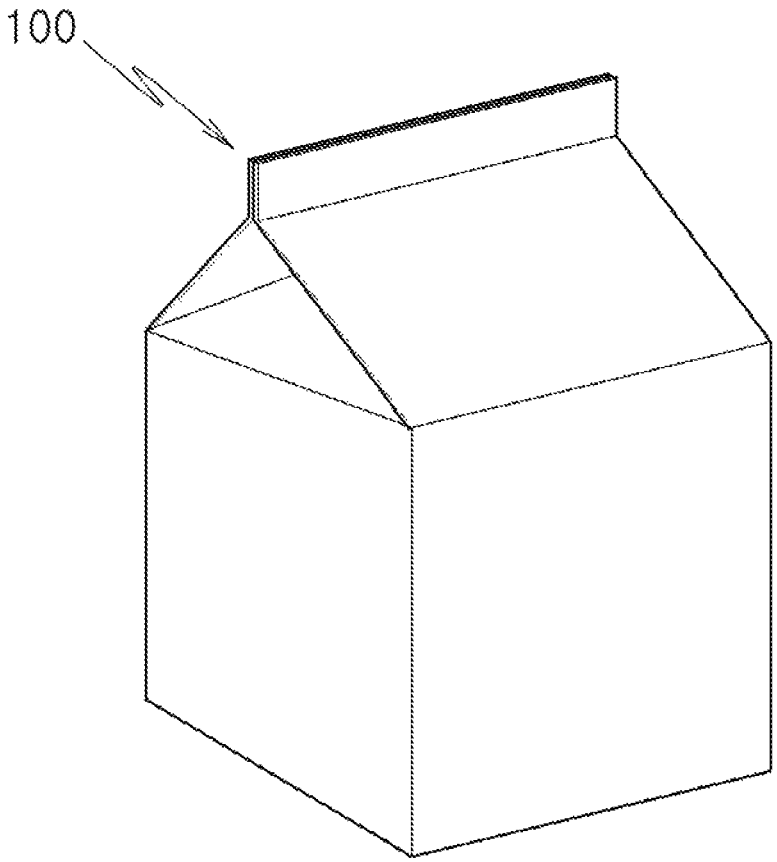
FIG. 7 shows a perspective of a completed liquid container.

FIG. 2 shows the container wherein the spout 10 is closed but first and second outer faces of the first and second distal wings respectively do not contact each other but are separated from each other. The first and second outer faces of the first and second distal wings as will be described later may be adhered to each other to complete the liquid container as shown in FIG. 7.

The first and second proximal wings have first and second proximal upper inner non-adhered faces 11*n* respectively. Correspondingly, the first and second distal wings have first and second distal upper inner non-adhered faces 12*n* respectively. The first and second proximal upper inner non-adhered faces 11*n* may be at the same level as the first and second distal upper inner non-adhered faces 12*n*. When the first and second proximal lower inner adhered faces 11*i* and first and second distal lower inner adhered faces 12*i* are adhered to each other respectively to allow the container to be closed at the spout 10, the first and second proximal upper inner non-adhered faces 11*n* contact but do not adhere to the first and second distal upper inner non-adhered faces 12*n* respectively. Thus, the spout 10 may be more easily opened due the inner non-adhered faces of the proximal and distal wings 11 and 12. Thus, the damage of the proximal and distal wings 11 and 12 may be prevented, which may occur when the inner non-adhered faces of the proximal and distal wings 11 and 12 are not present as in the conventional container.

The distal wings 12 may include first and second distal wings coupled to the first and second proximal wings respectively. The first and second distal wings have first and second distal lower outer adhered faces 12*a* respectively. The adhering between the first and second distal lower outer adhered faces 12*a* may allow the container to be completed as shown in FIG. 7. The first and second distal wings have first and second distal upper outer non-adhered faces 12*n* respectively. When the adhering between the first and second distal lower outer adhered faces 12*a* occurs, the first and second distal upper outer non-adhered faces 12*n* contacts but do not adhere to each other. Thus, the spout 10 may be more easily opened due the outer non-adhered faces of the distal wings 12. Thus, the damage of the distal wings 12 may be prevented, which may occur when the outer non-adhered faces of the distal wings 12 are not present as in the conventional container.

An anti-adhesion agent may be applied on the inner non-adhered faces of the proximal and distal wings 11 and 12 and the outer non-adhered faces of the distal wings 12. The example of the anti-adhesion agent may include an anti-adhesion oil.

Further, as shown in FIG. 4 and FIG. 1, the first and second proximal wings 11 may have first and second free end portions upwardly protruding from the first and second proximal upper inner non-adhered faces 11*n* respectively. The first and second free end portions have first and second free-end inner adhered faces 11*e* respectively. The adhering between the first and second free-end inner adhered faces 11*e* may allow more secure coupling between the first and second proximal wings 11.

Figure 3A:
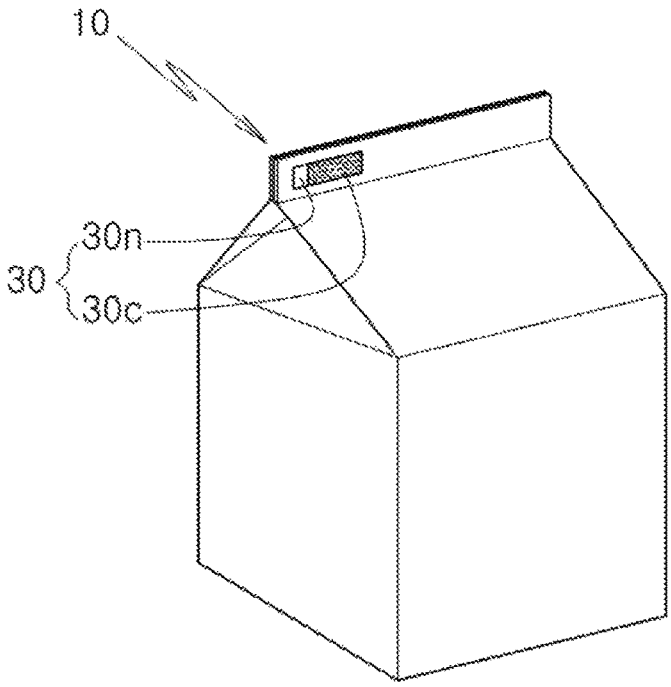
FIG. 3A shows a liquid container with easy opening of a spout thereof in accordance with the present disclosure where a closing tape is attached thereto.
Figure 3B:
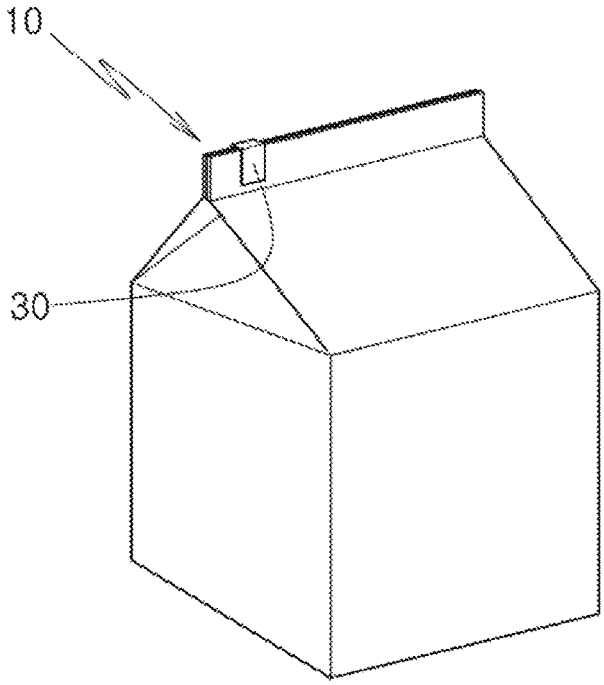
FIG. 3B shows a liquid container with easy opening of a spout thereof in accordance with the present disclosure where a closing tape is attached to the spout to close the spout.

In one example, as shown in FIGS. 3A and 3B, a closing tape 30 may be detachably attached to the body of the liquid container. After the adhered faces of the wings 11 and 12 of the spout 10 are separated first, the closing tape 30 may be attached to the spout 10 to close the spout to suppress the opening of the spout. The closing tape 30 may have an adhesive portion 30*c* and a non-adhesive portion 30*n* adjacent to the adhesive portion 30*c*.

What is claimed is:

1. A liquid container comprising:

a body having an inner space defined therein; and a spout coupled to the body at a top thereof, wherein the spout is to be opened to allow a liquid in the inner space to be discharged out of the inner space, wherein the spout includes first and second proximal wings extending from the body, and first and second distal wings extending from the first and second proximal wings respectively, wherein the first and second proximal wings have first and second proximal lower inner adhered faces respectively, wherein the first and second distal wings have first and second distal lower inner adhered faces respectively, wherein the first and second proximal lower inner adhered faces and first and second distal lower inner adhered faces are adhered to each other respectively, wherein the first and second proximal wings have first and second proximal upper inner non-adhered faces disposed above the first and second proximal lower inner adhered faces and extended to an upper end of the first and second proximal wings respectively, wherein the first and second distal wings have first and second distal upper inner non-adhered faces respectively, wherein the first and second proximal upper inner non-adhered faces are at the same level as the first and second distal upper inner non-adhered faces, wherein the first and second proximal upper inner non-adhered faces only contact but do not adhere to the first and second distal upper inner non-adhered faces respectively, wherein the first and second distal wings have first and second distal lower outer adhered faces respectively, wherein the first and second distal lower outer adhered faces are adhered to each other, wherein the first and second distal wings have first and second distal upper outer non-adhered faces respectively, wherein the first and second distal upper outer non-adhered faces only contacts but do not adhere to each other, wherein the first and second proximal wings have first and second free end portions upwardly protruding from the first and second proximal upper inner non-adhered faces respectively, wherein the first and second free end portions have first and second free-end inner adhered faces respectively, wherein the adhering between the first and second free-end inner adhered faces allows secure coupling between the first and second proximal wings, wherein an anti-adhesion agent is applied on the inner non-adhered faces of the proximal and distal wings and the outer non-adhered faces of the distal wings.

2. The container of claim 1, wherein a closing tape is detachably attached to the body of the liquid container, wherein after the adhered faces of the wings of the spout are separated first, the closing tape is displaced to the spout to close the spout, and wherein a closing tape has an adhesive portion and a non-adhesive portion adjacent to the adhesive portion.

* * * * *